US010830487B2

(12) United States Patent
Naraharisetti et al.

(10) Patent No.: US 10,830,487 B2
(45) Date of Patent: Nov. 10, 2020

(54) SECURED METHOD OF CONTROLLING A SMOKE CONTROL SYSTEM

(71) Applicant: Honeywell International Inc., Morris Plains, NJ (US)

(72) Inventors: Kanaka Nagendra Prasad Naraharisetti, Bangalore (IN); Rajesh Babu Nalukurthy, Bangalore (IN); P Ranjith Kumar, Bangalore (IN); Rich Lau, Morris Plains, NJ (US)

(73) Assignee: Honeywell International Inc., Charlotte, NC (US)

( * ) Notice: Subject to any disclaimer, the term of this patent is extended or adjusted under 35 U.S.C. 154(b) by 8 days.

(21) Appl. No.: 16/245,104

(22) Filed: Jan. 10, 2019

(65) Prior Publication Data

US 2020/0224921 A1 Jul. 16, 2020

(51) Int. Cl.

| | |
|---|---|
| ***F24F 13/10*** | (2006.01) |
| ***F24F 11/33*** | (2018.01) |
| ***A62C 2/24*** | (2006.01) |

(52) U.S. Cl.
CPC ..... *F24F 13/10* (2013.01); *F24F 11/33* (2018.01); *A62C 2/24* (2013.01)

(58) Field of Classification Search
CPC ..... F24F 13/10; F24F 11/33; A62C 2/24
See application file for complete search history.

(56) References Cited

U.S. PATENT DOCUMENTS

| | | | | |
|---|---|---|---|---|
| 10,001,288 | B1 * | 6/2018 | Yang | F24F 13/10 |
| 2002/0155807 | A1 * | 10/2002 | Moor | F24F 7/007 454/342 |
| 2004/0090327 | A1 * | 5/2004 | Soloway | G08B 13/08 340/545.1 |
| 2006/0101721 | A1 * | 5/2006 | Weik, III | A62C 2/24 52/1 |
| 2007/0208438 | A1 * | 9/2007 | El-Mankabady | G05B 15/02 700/83 |
| 2010/0024992 | A1 | 2/2010 | Cloninger et al. | |
| 2017/0115019 | A1 * | 4/2017 | Desmet | G05B 15/02 |

FOREIGN PATENT DOCUMENTS

| | | | |
|---|---|---|---|
| CN | 2090709 | U | 12/1991 |
| CN | 2124743 | U | 12/1992 |
| CN | 1800740 | A | 7/2006 |
| CN | 201018911 | Y | 2/2008 |
| CN | 103674762 | A | 3/2014 |
| CN | 104457852 | A | 3/2015 |
| CN | 204745455 | U | 11/2015 |

(Continued)

*Primary Examiner* — Sisay Yacob
(74) *Attorney, Agent, or Firm* — Brooks, Cameron & Huebsch, PLLC

(57) ABSTRACT

A secured method of controlling a smoke control system is described herein. One device includes a user interface configured to display a smoke control element that represents a component of a smoke control system of a facility, receive a password, and receive a selection of an action to be performed by the component of the smoke control system, a memory, and a processor configured to execute executable instructions stored in the memory to cause the action to be performed by the component of the smoke control system in response to verifying the password is valid.

16 Claims, 3 Drawing Sheets

(56) References Cited

FOREIGN PATENT DOCUMENTS

| | | | |
|---|---|---|---|
| CN | 205245265 | U | 5/2016 |
| CN | 205245266 | U | 5/2016 |
| CN | 106781219 | A | 5/2017 |
| CN | 207025753 | U | 2/2018 |
| CN | 108109326 | A | 6/2018 |
| GB | 2112283 | A | 7/1983 |
| WO | 2015200547 | A1 | 12/2015 |

* cited by examiner

SECURED METHOD OF CONTROLLING A SMOKE CONTROL SYSTEM

TECHNICAL FIELD

The present disclosure relates generally to a secured method of controlling a smoke control system.

BACKGROUND

Large facilities (e.g., buildings), such as commercial facilities, office buildings, hospitals, and the like, may have smoke control systems that can be used during an emergency situation (e.g., a fire) to manage the flow of smoke through the facility. For example, a smoke control system may include a number of components, such as fans and/or dampers, located throughout the facility (e.g., on different floors of the facility) that can be used to perform smoke control operations, such as pressurizing, purging, exhausting, etc.

A smoke control system may also include a physical smoke control panel (e.g., box) installed in the facility that can be used by a user (e.g., operator) with a key to directly control the operation of the components of the smoke control system. However, a smoke control system accessed by a control panel using a key can allow unauthorized altering of the smoke control system which can cause the system to become unstable. Further, it can allow the activation or deactivation of components of the smoke control system without proper logic, which can cause harm or discomfort in the form of suffocation or uncomfortable breathing to the building's occupants with abnormal humidity levels or oxygen levels, for example.

DETAILED DESCRIPTION

Figure 1:
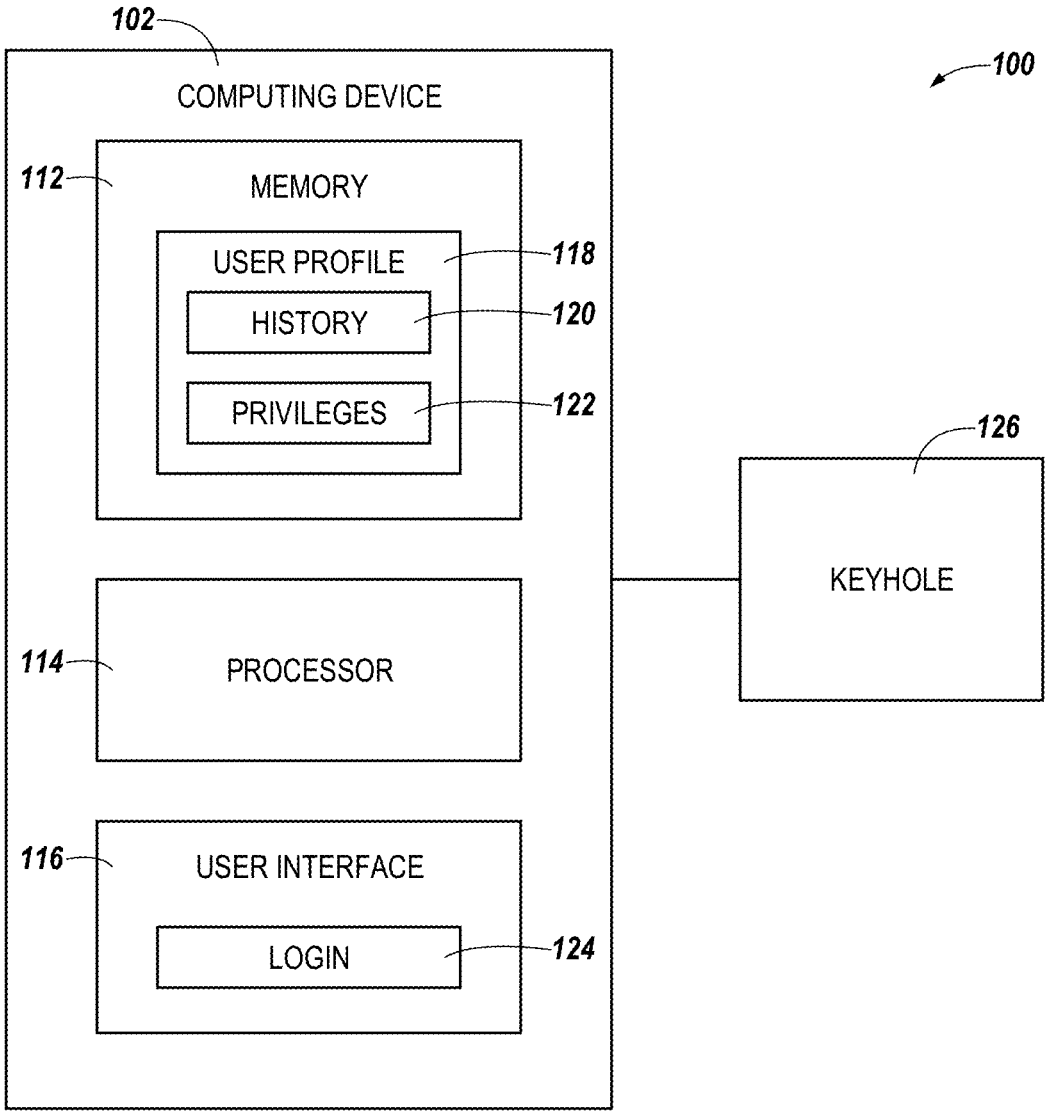
FIG. 1 illustrates an example of a device for securing a smoke control system in accordance with an embodiment of the present disclosure.

A secured method of controlling a smoke control system is described herein. For example, an embodiment includes a user interface configured to display a smoke control element that represents a component of a smoke control system of a facility, receive a password, and receive a selection of an action to be performed by the component of the smoke control system, a memory, and a processor configured to execute executable instructions stored in the memory to cause the action to be performed by the component of the smoke control system in response to verifying the password is valid.

In contrast to previous smoke control systems in which a physical smoke control panel is installed in a facility and a key is needed to control the operation of the components (e.g., fans and/or dampers) of the smoke control system, smoke control systems in accordance with the present disclosure allow for the smoke control system to be accessed by entering a username and/or password using a user interface with digital graphics (e.g., widgets) displayed to a user (e.g., operator) on a digital display (e.g., a computer screen). Accordingly, smoke control systems in accordance with the present disclosure may be significantly more secure than previous smoke control systems and, in some examples, can also include a keyhole to receive physical keys instead of or in conjunction with entering a username and/or password to further enhance the security of the smoke control system.

As such, smoke control systems in accordance with the present disclosure can be more stable, less prone to tampering, and safer than previous smoke control systems that utilize a physical control panel accessed with a physical key. Further, smoke control systems in accordance with the present disclosure can make it possible to remotely access the smoke control system and to monitor and limit the control of users to particular components of the smoke control system.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 illustrates an example of a device 100 for securing a smoke control system in accordance with an embodiment of the present disclosure. The smoke control system can be the smoke control system of a facility (e.g., building), such as, for instance, a large facility having a large number of floors, such as a commercial facility, office building, hospital, and the like. However, embodiments of the present disclosure are not limited to a particular type of facility.

The device 100 for securing the smoke control system can include computing device 102. Computing device 102 can be, refer to, and/or include a laptop computer, desktop computer, or mobile device, such as, for instance, a smart phone or tablet, among other types of computing devices. However, embodiments of the present disclosure are not limited to a particular type of computing device. Computing device 102 may be located at the facility, such as, for instance, in a control room or operating room of the facility or may be located remotely from the facility.

The smoke control system can be used during an emergency situation (e.g., a fire) to manage the flow of smoke through the facility. For example, the smoke control system may include a number of components, such as fans and/or dampers, located throughout the facility (e.g., on different floors of the facility) that can be used to perform smoke control operations, such as pressurizing, purging, exhausting, etc., in the facility. As used herein, controlling the smoke control system can include and/or refer to monitoring and/or controlling the components (e.g., the operation of the components) of the smoke control system, as will be further described herein.

Computing device 102 can secure, monitor, and/or control the components of the smoke control system via a wired or wireless network. The network can be a network relationship through which computing device 102 can communicate with the components of the smoke control system. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network can include a number of servers that receive information from, and transmit information to, computing device 102 and the components of the smoke control system via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

As shown in FIG. 1, computing device 102 can include a processor 114 and a memory 112. Memory 112 can be any type of storage medium that can be accessed by processor 114 to perform various examples of the present disclosure. For example, memory 112 can be a non-transitory computer readable medium having computer readable instructions (e.g., computer program instructions) stored thereon that are executable by processor 114 to secure and control a smoke control system in accordance with the present disclosure. That is, processor 114 can execute the executable instructions stored in memory 112 to allow access to and control of a smoke control system in accordance with the present disclosure.

In some embodiments, memory 112 can store user profiles 118. Each user (e.g., operators) of the device 100 can have a user profile. A particular user profile can be accessed in response to the particular user logging in to the device 100 (e.g., computing device 102) or by an administrator. The user profile 118 can include data specific to each user including user history 120 and user privileges 122.

The user history 120 can include previous actions selected by the user for performance by the smoke control system (e.g., by components of the smoke control system). The actions can include turning on or off fans and/or opening or closing dampers, for example, as will be further described herein. Each of the previous actions can identify the particular component that performed the action and include a timestamp of when the action was performed. In some examples, these previous actions can be reviewed by a different user with administrative access to determine whether the user's selected actions were correct.

The user privileges 122 can be based on a key, a username, and/or a password of the user. In some examples, the username and/or password can be entered via a keyboard. The privileges 122 can include which zones of the facility the user can control (e.g., perform actions). Zones can be designated based on floors, rooms, smoke control elements, and/or smoke control element types, for example. The privileges 122 can include which operations the user can perform (e.g., select to be performed). For example, a user could be limited to auto and/or manual operations (e.g., being controlled by the user of computing device 102). The privileges 122 can also include what the user can view. For example, a user could be limited to viewing the smoke control elements within a particular zone, faulty smoke control elements, auto mode smoke control elements, and/or operation states of the smoke control elements. In some examples, the privileges 122 can be modified by a different user with administrative access.

In some embodiments, the user interface 116 can display a smoke control element that represents a component of the smoke control system (e.g., a damper or a fan) of a facility and receive a selection of an action to be performed by the component of the smoke control system. The computing device 102 can determine the privileges of the user who made the selection using privileges 122 and determine whether to perform the action based on the user's privileges. For example, if the user's privileges 122 do not include the action selected by the user, the smoke control system will not perform (e.g., ignore) the action.

The user can log out and/or can be logged out from the smoke control system. For example, the user can be logged out in response to the user being logged in to the smoke control system for a particular time. Timed logouts can prevent an unauthorized user from performing actions using a user's login if a user forgets to logout of the smoke control system. Timed logouts can also allow other users to access the smoke control system after a particular time if a user forgets to logout of the smoke control system. In some examples, a user can be logged out of the smoke control system in response to an additional user (e.g., different user) logging in to the smoke control system. For example, the additional user can have priority over the user. In some examples, the priority of users to be logged in to the smoke control system and/or perform actions on the smoke control system can be determined based on a comparison of privileges 122 or a priority level set in the user profile 118.

In some examples, a user and/or user interface 116 can be authorized access to the smoke control system. The user and/or user interface 116 can be authorized access to the smoke control system based on an activation of a module in the facility. In some examples, the module can be coupled to the smoke control system.

The smoke control system can include a combination of devices to provide control functionality for the smoke control system. The combination of devices can be, for example, a plurality of manual call points. The combination of devices can be activated to provide control functionality for the smoke control system. In some examples, multi-factor authentication can be provided in response to the combination of devices being activated.

Memory 112 can be volatile or nonvolatile memory. Memory 112 can also be removable (e.g., portable) memory, or non-removable (e.g., internal) memory. For example, memory 112 can be random access memory (RAM) (e.g., dynamic random access memory (DRAM), resistive random access memory (RRAM), and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 112 is illustrated as being located in computing device 102, embodiments of the present disclosure are not so limited. For example, memory 112 can also be located internal to another computing resource (e.g., enabling computer readable instructions to be downloaded over the Internet or another wired or wireless connection).

As shown in FIG. 1, computing device 102 can include a user interface 116. A user of computing device 102, such as, for instance, an operator of the smoke control system, can interact with computing device 102 via user interface 116. For example, user interface 116 can provide (e.g., display) information to and/or receive information from (e.g., input by) the user of computing device 102.

In some embodiments, user interface 116 can be a graphical user interface (GUI) that can include a display (e.g., a screen) that can provide information to, and/or receive information from, the user of computing device 102. The display can be, for instance, a touch-screen (e.g., the GUI can include touch-screen capabilities). As an additional example, user interface 116 can include a keyboard and/or mouse the user can use to input information into computing device 102, and/or a speaker that can play audio to, and/or receive audio (e.g., voice input) from, the user. Embodiments of the present disclosure, however, are not limited to a particular type(s) of user interface.

As an example, user interface 116 can display a user login 124 into which the user of computing device 102 can input a username and/or password, and the user interface 116 can receive the username and/or password. Once computing device 102 determines a valid username and/or password has been received, the user interface 116 can display a plurality of smoke control elements (e.g., widgets) with which the user of computing device 102 can interact (e.g., through direct manipulation) based on the user's privileges 122.

In some embodiments, the device 100 for securing the smoke control system can include a keyhole 126 configured to receive a key. As previously discussed, the user's privileges 122 can be based on the key received by the keyhole. In some examples, the user interface 116 can display the plurality of smoke control elements in response to computing device 102 determining the keyhole 126 has received a key and verifying the received key is valid and/or the user interface 116 has received a valid password (e.g., in response to computing device 102 verifying the key and/or password is valid). The processor 114 can be configured to receive a selection of an action to be performed by the component of the smoke control system represented by a smoke control element and/or execute executable instructions stored in the memory 112 to verify the password is valid and cause the action to be performed by the component of the smoke control system in response to the keyhole 126 receiving a key and verifying the key is valid and/or the user interface 116 verifying the password is valid.

Each respective one of the displayed smoke control elements can represent a different component (e.g., a different damper or fan) of the smoke control system of the facility and can include a plurality of actions that can be performed by (e.g., selected by the user to be performed by) the component represented by that smoke control element. For example, the actions included in a smoke control element that represents a damper of the smoke control system can include opening the damper, closing the damper, and operating the damper in auto mode. As an additional example, the actions included in a smoke control element that represents a fan of the smoke control system can include turning (e.g., switching) on the fan, turning off the fan, and operating the fan in auto mode.

Further, each respective one of the displayed smoke control elements can include an indication of the current operational state of the component represented by that smoke control element. For example, the indication of the current operational state included in a smoke control element that represents a damper of the smoke control system can be an indication of whether the damper is open or closed (e.g., the current operational state of the damper may be open or closed). Further, the indication of the current operational state included in a smoke control element that represents a fan of the smoke control system can be an indication of whether the fan is on or off (e.g., the operational state of the fan may be on or off).

Further, each respective one of the displayed smoke control elements can include an indication of whether the component represented by that smoke control element is operating normally, or has a fault associated therewith (e.g., is faulty).

Further, user interface 116 can display an indication of whether all the components of the smoke control system of the facility are operating in auto mode, or any of the components are being operated manually (e.g., being controlled by the user of computing device 102). Further, user interface 116 can display an indication of whether any of the components of the smoke control system of the facility have a fault associated therewith (e.g., whether any of the components are faulty).

User interface 116 can receive, via one of the displayed smoke control elements, a selection of an action to be performed by the component of the smoke control system of the facility represented by that smoke control element. For example, the user of computing device 102 can select one of the plurality of actions included in that smoke control element to be performed by the component represented by that smoke control element. The user can select the action to be performed by, for example, using the mouse of the user interface to select the action in that smoke control element in the display, or by touching the action in that smoke control element in the display.

As an example, if the user would like to open or close a particular damper of the smoke control system of the facility, the user can select that action in the displayed smoke control element that represents that damper. As an additional example, if the user would like to turn a particular fan of the smoke control system on or off, the user can select that action in the displayed smoke control element that represents that fan. As an additional example, if the user would like a particular damper or fan of the smoke control system to operate in auto mode, the user can select that action in the displayed smoke control element that represents that damper or fan.

Upon user interface 116 receiving the selection of the action, computing device 102 can cause the action to be performed by the component of the smoke control system represented by the smoke control element that received the selection. For example, computing device 102 can send (e.g., via the network previously described herein) an instruction (e.g., command) to that component to perform the selected action, and the component can perform the selected action upon receipt of the instruction.

Figure 2A:
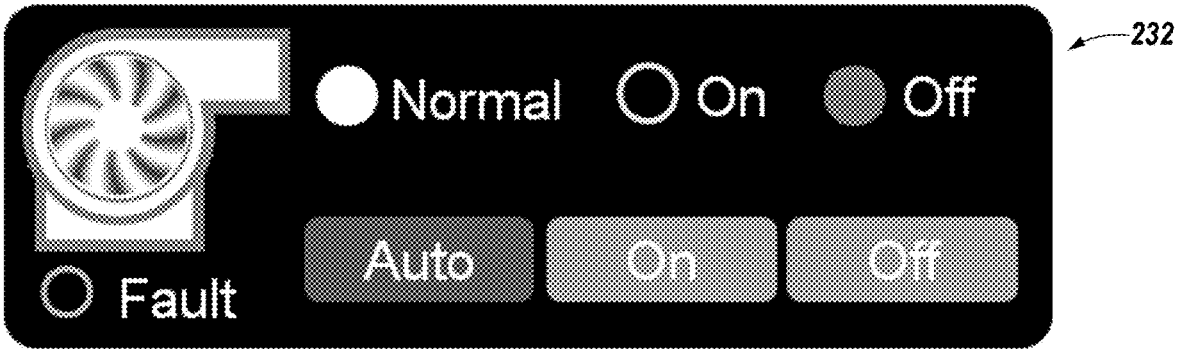
FIGS. 2A-2B illustrate examples of smoke control elements in accordance with an embodiment of the present disclosure.
Figure 2B:
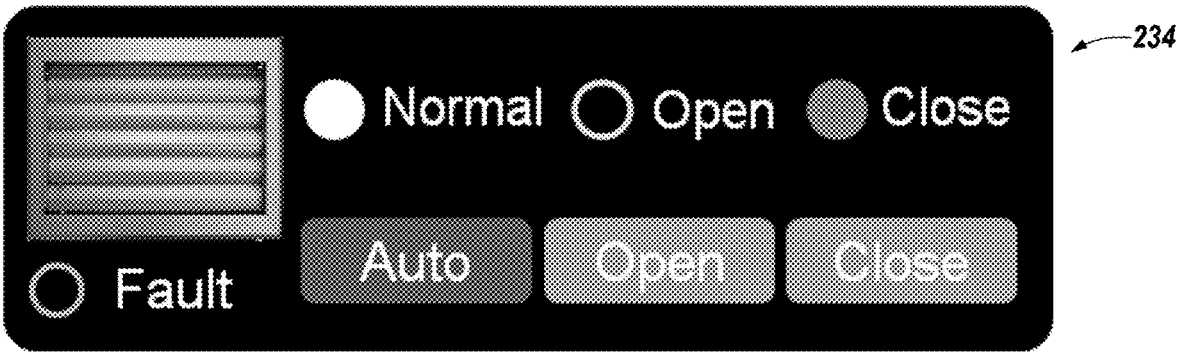

FIGS. 2A-2B illustrate examples of smoke control elements (e.g., widgets) in accordance with an embodiment of the present disclosure. For instance, FIG. 2A illustrates an example of a smoke control element 232 that represents a fan of a smoke control system of a facility, and FIG. 2B illustrates an example of a smoke control element 234 that represents a damper of a smoke control system of a facility. Smoke control elements 232 and 234 can be displayed on a user interface, such as, for instance, user interface 116 of computing device 102 previously described in connection with FIG. 1, and the smoke control system of the facility can be analogous to the smoke control system of the facility previously described in connection with FIG. 1.

As shown in FIGS. 2A and 2B, smoke control elements 232 and 234 each include three different actions (e.g., selectable icons corresponding to three different actions) that can be performed by the fan and damper, respectively, that they represent. For instance, smoke control element 232 includes the actions of turning (e.g., switching) on the fan (represented by the "On" icon at the bottom of the control element), turning off the fan (represented by the "Off" icon at the bottom of the control element), and operating the fan in auto mode (represented by the "Auto" icon at the bottom of the control element). Smoke control element 234 includes the actions of opening the damper (represented by the "Open" icon at the bottom of the control element), closing the damper (represented by the "Close" icon at the bottom of the control element), and operating the damper in auto mode (represented by the "Auto" icon at the bottom of the control element). In some examples, the user interface (e.g., user interface 116 in FIG. 1) can display the one or more actions based on the user's privileges (e.g., privileges 122 in FIG. 1).

A user can select one of the actions (e.g., the icon representing that actions) to be performed by the fan or damper, and the fan or damper can perform the selected action responsive to the selection in response to receiving a username, password, and/or key, as previously described herein (e.g., in connection with FIG. 1). In some examples, the user can be authorized to do one or more actions based on the user's privileges (e.g., privileges 122 in FIG. 1). In the examples illustrated in FIGS. 2A and 2B, the fan and damper, respectively, have been selected to operate in auto mode (represented by the illumination of the "Auto" icon in each respective control element).

Further, as shown in FIGS. 2A and 2B, smoke control elements 232 and 234 can include an indication of the current operational state of the fan and damper, respectively, that they represent. For instance, smoke control element 232 includes an indication that the current operational state of the fan is off (represented by the "Off" indicator at the top of the control element being illuminated, while the "On" indicator at the top of the control element is not illuminated), and smoke control element 234 includes an indication that the current operational state of the damper is closed (represented by the "Close" indicator at the top of the control element being illuminated, while the "Open" indicator at the top of the control element is not illuminated). In some examples, the user interface (e.g., user interface 116 in FIG. 1) can display the current operational state of the fan and damper based on the user's privileges (e.g., privileges 122 in FIG. 1).

Further, as shown in FIGS. 2A and 2B, smoke control elements 232 and 234 can include a visual representation of the type of component of the smoke control system they represent. For example, smoke control element 232 includes a visual representation of a fan, and smoke control element 234 includes a visual representation of a damper.

Further, as shown in FIGS. 2A and 2B, smoke control elements 232 and 234 can include an indication of whether the fan and damper, respectively, that they represent is operating normally, or has a fault associated therewith. For instance, smoke control elements 232 and 234 includes an indication that the fan and damper, respectively are operating normally (represented by the "Normal" indicator being illuminated, while the "Fault" indicator is not illuminated). If the fan or damper were to have a fault associated therewith (e.g., be faulty), the "Fault" indicator in smoke control element 232 or 234, respectively, would be illuminated. In some examples, the user interface (e.g., user interface 116 in FIG. 1) can display whether a fan and/or a damper is operating normally or has a fault based on the user's privileges (e.g., privileges 122 in FIG. 1).

Figure 3:
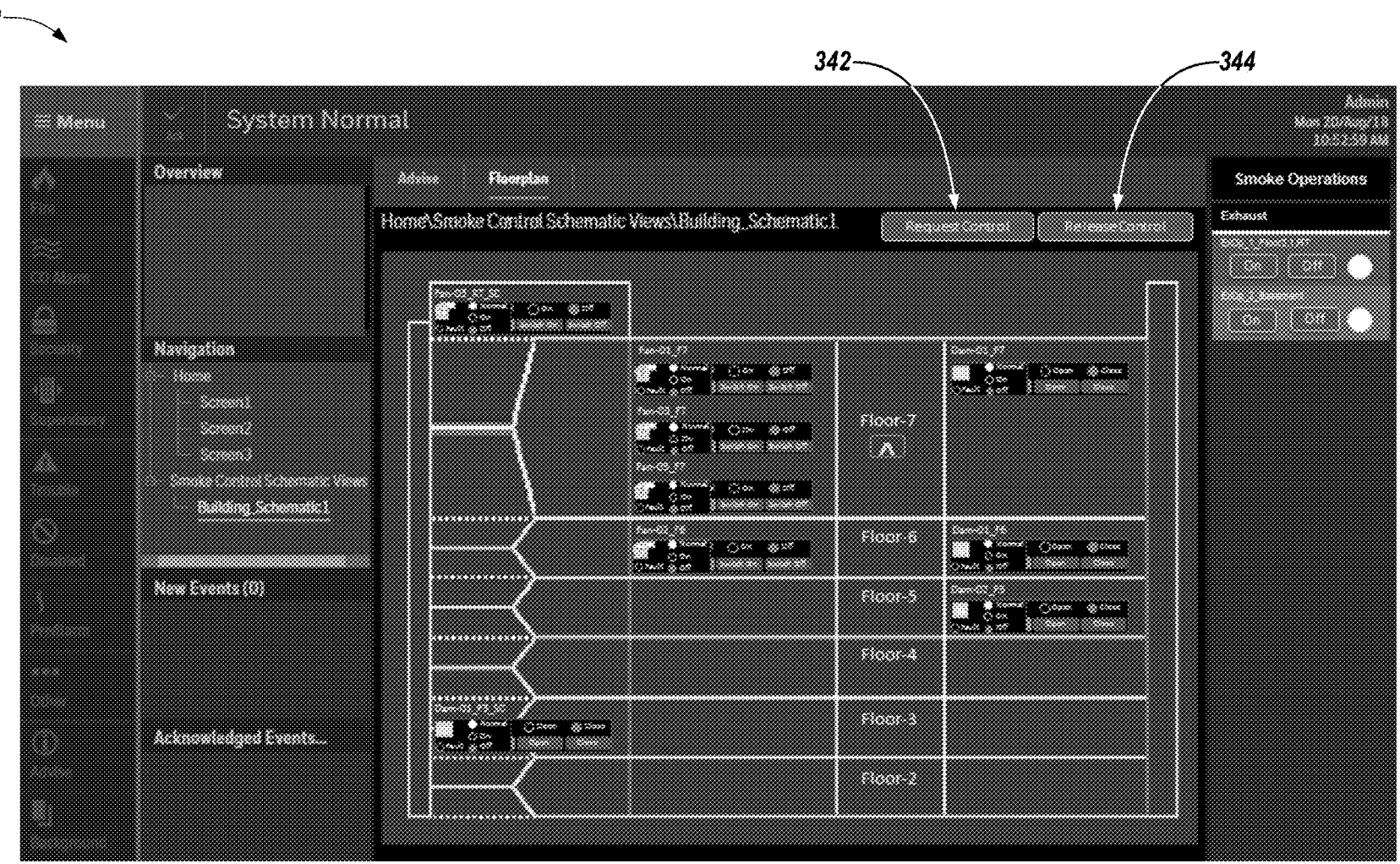
FIG. 3 illustrates an example of a display of smoke control elements representing different components of a smoke control system of a facility in accordance with an embodiment of the present disclosure.

FIG. 3 illustrates an example of a display 340 of smoke control elements representing different components of a smoke control system of a facility in accordance with an embodiment of the present disclosure. Display 340 can be displayed on a user interface, such as, for instance, user interface 116 of computing device 102 previously described in connection with FIG. 1, and the smoke control system of the facility can be analogous to the smoke control system of the facility previously described in connection with FIG. 1.

The display 340 can be displayed on the user interface (e.g., user interface 116 in FIG. 1) in response to a user entering a valid password and/or username into the user interface. In some examples, the display 340 can be displayed on the user interface in response to receiving a valid key, and/or password, as previously described herein.

As shown in FIG. 3, display 340 includes a plurality of smoke control elements (e.g., widgets) that each represent a different component of the smoke control system of a facility. For example, display 340 includes smoke control elements representing a damper in the floor 3 staircase of the facility, a fan in the rooftop staircase of the facility, a damper on floor 5 of the facility, a fan and damper on floor 6 of the facility, and three fans and one damper on floor 7 of the facility, as illustrated in FIG. 3. Each smoke control element includes a plurality of actions that can be performed by the component represented by that smoke control element, an indication of the current operational state of the component represented by that smoke control element, a visual representation of the type of component represented by that smoke control element, and an indication of whether the component represented by that smoke control element is operating normally, or has a fault associated therewith, in a manner analogous to that previously described herein.

Further, as shown in FIG. 3, display 340 can include a schematic floor plan of the facility divided into zones. The schematic floor plan of the facility can include zones designated as different floors of the facility (e.g., floors 2 through 7), and the staircase of the facility, as illustrated in FIG. 3. However, the zones are not limited to floors. Zones can also be designated based on rooms, smoke control elements, and/or smoke control element types, for example.

The display 340 can include a request control 342 icon. A user can request control of a smoke control element (e.g., a damper or a fan) and/or zone (e.g., floors 2 through 7). The user can request control by selecting the control element and/or zone the user would like to control and then select the request control 342 icon. In response, the user can control the requested smoke control element and/or zone. For example, the user can monitor, turn on or off fans, and/or open or close dampers when the user has control. In some examples, the user interface can receive the request to control the user selected control element and/or zone, determine the privileges of the user using privileges (e.g., privileges 122 in FIG. 1), and determine whether to give the user control based on the user's privileges. For example, if the user's privileges do not include control of the requested smoke control element and/or zone, the smoke control system will not allow the user control of the requested smoke control element and/or zone. In some examples, the user can request control of a smoke control element and/or zone from an additional user (e.g., different user) who currently has control of the control element and/or zone. In some examples, if the additional user has priority over the user, the smoke control system will not allow the user control of the requested smoke control element and/or zone. The priority of users to have control of a requested smoke control element and/or zone can be determined based on a comparison of privileges and/or priority level set in the user profile (e.g., user profile 118 in FIG. 1).

The display 340 can further include a release control 344 icon. A user can release control of a smoke control element and/or zone (e.g., floors 2 through 7) by selecting the control element and/or zone the user would like to release control of and then select the release control 344 icon. In response, the user no longer has control of the requested smoke control element and/or zone and an additional user, for example, can request control of the control element and/or zone. For example, the user cannot monitor, turn on or off fans, and/or open or close dampers when the user no longer has control of the smoke control element and/or zone.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A device for securing a smoke control system, comprising:

a keyhole configured to receive a key;

a user interface configured to:

display a smoke control element that represents a component of a smoke control system of a facility;

receive a password; and receive a selection of an action to be performed by the component of the smoke control system;

a memory; and a processor configured to execute executable instructions stored in the memory to:

verify the password is valid; and cause the action to be performed by the component of the smoke control system in response to verifying the password is valid and in response to the keyhole receiving a valid key.

2. The device of claim 1, wherein the user interface is configured to receive the selection of the action to be performed by the component of the smoke control system in response to the keyhole receiving the valid key.

3. The device of claim 1, wherein the user interface is further configured to display a plurality of additional smoke control elements, wherein each respective one of the additional smoke control elements represents a different component of the smoke control system.

4. The device of claim 3, wherein the user interface is configured to display the plurality of additional smoke control elements in response to the keyhole receiving the valid key.

5. The device of claim 1, wherein the component of the smoke control system is a damper of the smoke control system.

6. The device of claim 1, wherein the component of the smoke control system is a fan of the smoke control system.

7. A method for securing a smoke control system, comprising:

displaying, on a user interface of a computing device, a plurality of smoke control elements, wherein each respective one of the displayed smoke control elements represents a different damper or fan of a smoke control system of a facility;

receiving, via one of the displayed smoke control elements, a selection of an action to be performed by the damper or fan represented by that smoke control element;

receiving, by a keyhole of the computing device, a key;

verifying, by the computing device, the received key is valid; and performing, by the damper or fan represented by the smoke control element that received the selection of the action, the action in response to verifying the key is valid.

8. The method of claim 7, further comprising receiving a selection of an additional action to be performed by the damper or fan represented by that smoke control element.

9. The method of claim 8, further comprising:

determining privileges of a user of the computing device; and not performing the additional action based on the user's privileges.

10. The method of claim 9, wherein the user's privileges are based on the received key.

11. The method of claim 9, wherein the user's privileges are based on a password of the user.

12. The method of claim 7, further comprising authorizing access to the smoke control system based on an activation of a module in the facility that is coupled to the smoke control system.

13. The method of claim 7, further comprising providing multi-factor authentication where a combination of devices are activated to provide control functionality for the smoke control system.

14. A non-transitory computer readable medium having computer readable instructions stored thereon that are executable by a processor to:

receive, via a keyboard, a password for a user profile to login a user to a smoke control system of a facility;

display, on a graphical user interface, a plurality of smoke control elements, wherein each respective one of the displayed smoke control elements represents a different component of the smoke control system of a facility;

receive, via one of the displayed smoke control elements, a selection of an action to be performed by the component of the smoke control system represented by that smoke control element;

determine privileges corresponding to the user profile;

cause the action to be performed by the component of the smoke control system represented by the smoke control element that received the selection of the action in response to the action being included in the privileges corresponding to the user profile; and log out the user from the smoke control system in response to an additional user logging into the smoke control system.

15. The computer readable medium of claim 14, wherein the instructions are executable by the processor to log out the user from the smoke control system in response to the user being logged in to the smoke control system for a particular time.

16. The computer readable medium of claim 14, wherein the additional user has priority over the user.

* * * * *